US011079703B2

(12) United States Patent
Suzuki

(10) Patent No.: US 11,079,703 B2
(45) Date of Patent: Aug. 3, 2021

(54) FIXING APPARATUS AND IMAGE FORMING APPARATUS

(71) Applicant: Canon Kabushiki Kaisha, Tokyo (JP)

(72) Inventor: Takafumi Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/069,107

(22) Filed: Oct. 13, 2020

(65) Prior Publication Data

US 2021/0116847 A1 Apr. 22, 2021

(30) Foreign Application Priority Data

Oct. 18, 2019 (JP) ..... 2019-191261

(51) Int. Cl.
*G03G 15/20* (2006.01)
*G03G 21/16* (2006.01)

(52) U.S. Cl.
CPC ..... *G03G 15/2025* (2013.01); *G03G 15/2064* (2013.01); *G03G 21/1685* (2013.01)

(58) Field of Classification Search
CPC ..... G03G 15/2025; G03G 15/2064; G03G 21/1685
See application file for complete search history.

(56) References Cited

U.S. PATENT DOCUMENTS 5,708,926 A * 1/1998 Sagara ..... G03G 15/2064 399/122
2009/0123202 A1* 5/2009 Yoshinaga ..... G03G 15/2032 399/329
2013/0279957 A1* 10/2013 Kasama ..... G03G 15/2064 399/329

FOREIGN PATENT DOCUMENTS

JP 63226682 A 9/1988
JP 784419 A 3/1995
JP 200577615 A 3/2005
JP 200725571 A 2/2007

* cited by examiner

*Primary Examiner* — Gregory H Curran
(74) *Attorney, Agent, or Firm* — Venable LLP

(57) ABSTRACT

A fixing apparatus includes a first rotary member, a second rotary member configured to form a nip portion with the first rotary member, a frame including a pair of side plates, a pressing member, an urging member configured to urge the pressing member, a second shaft supported by the pair of side plates. Each of the pair of side plates includes an opening portion into which the second shaft enters, and a bearing groove which communicates with the opening portion. The bearing groove includes a receiving portion which receives an urging force which the second shaft receives from the urging member in a state where the second shaft is supported by the pair of side plates. The receiving portion is disposed at a position which is farther apart from the pressing member than the opening portion.

14 Claims, 11 Drawing Sheets

FIXING APPARATUS AND IMAGE FORMING APPARATUS

BACKGROUND OF THE INVENTION

Field of the Invention

The present invention relates to a fixing apparatus which fixes a toner image to a sheet and an image forming apparatus which includes the fixing apparatus.

Description of the Related Art

In an image forming apparatus such as a printer, a fixing apparatus which fixes a toner image to a sheet at a nip portion between a heating member and a pressing member is provided. With respect to the fixing apparatus as described above, Japanese Patent Laid-Open No. 2007-25571 discloses a configuration which includes a nip pressure adjustment mechanism capable of changing pressure on the sheet at the nip portion by rotating a cam fixed to a rotation shaft depending on a thickness and the like of the sheet.

Incidentally, it has become desirable to extend the life of an image forming apparatus in recent years, and investigation has been made into making components of the image forming apparatus replaceable. For example, since in a consumable component such as the cam mentioned above wear progresses with an extended period of use of the image forming apparatus, a replaceable configuration is desirable.

In the fixing apparatus disclosed in Japanese Patent Laid-Open No. 2007-25571, the rotation shaft of the cam is fixed to a bearing disposed at a frame of the image forming apparatus. Therefore, since it is necessary to handle the fixing apparatus in one piece when mounting the rotation shaft of the cam on the bearing disposed at the frame, the ease of assembly and replacement of the consumable component is deteriorated.

SUMMARY OF THE INVENTION

According to one aspect of the present invention, a fixing apparatus includes a first rotary member configured to rotate around a first shaft, a second rotary member disposed so as to come into contact with and separate from the first rotary member, and configured to form a nip portion with the first rotary member, a heater configured to heat the nip portion, a frame including a pair of side plates, a pressing member supported by the pair of side plates, and configured to press the second rotary member, wherein the pressing member is configured to be movable between a first position, where a distance between center positions of the first rotary member and the second rotary member is a first distance, and a second position, where the distance between the center positions of the first rotary member and the second rotary member is a second distance which is larger than the first distance, an urging member configured to urge the pressing member toward the first position, a second shaft supported by the pair of side plates so as to be attachable to and detachable from the pair of side plates, and a cam rotatably supported by the second shaft, and configured to change a position of the pressing member between the first position and the second position. Each of the pair of side plates includes an opening portion which is disposed at an edge of each of the pair of side plates and into which the second shaft enters, and a bearing groove which communicates with the opening portion. The bearing groove includes a receiving portion which receives an urging force which the second shaft receives from the urging member via the pressing member and the cam in a state where the second shaft is supported by the pair of side plates. The receiving portion is disposed at a position which is farther apart from the pressing member than the opening portion in an urging direction of the urging member when viewed in an axial direction of the first shaft.

Further features of the present invention will become apparent from the following description of exemplary embodiments with reference to the attached drawings.

DESCRIPTION OF THE EMBODIMENTS

Hereinafter, embodiments included in this disclosure will be described with reference to attached drawings. To be noted, sizes, materials, shapes, relative positions, and the like of components described below do not limit the scope of embodiments included in the present disclosure, and are to be appropriately changed depending on configurations and various conditions of an apparatus to which the present disclosure is applied.

First Embodiment

General Configuration of Image Forming Apparatus

Figure 2:
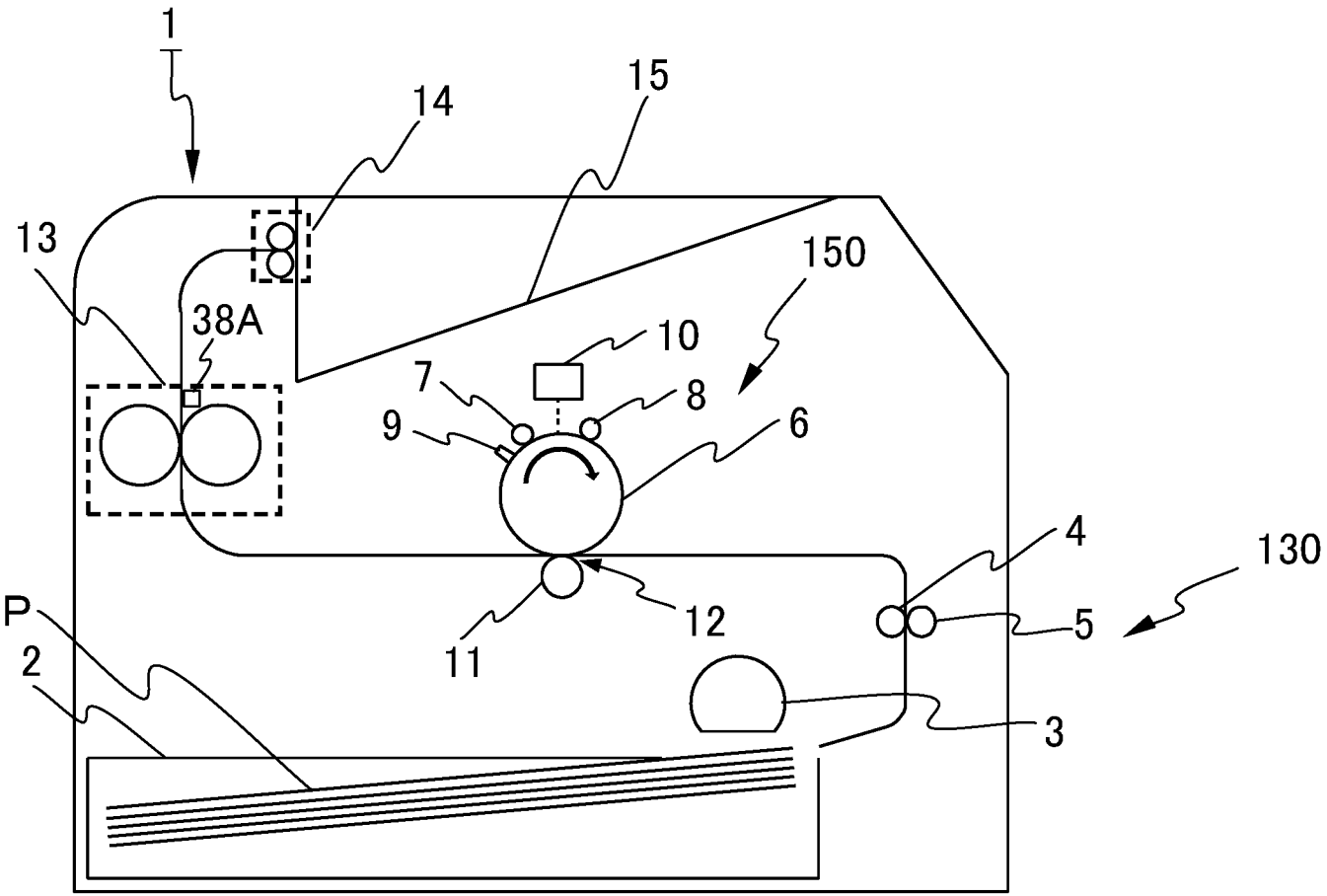
FIG. 2 is a diagram showing a general configuration of an image forming apparatus of the first embodiment.

First, a general configuration of an image forming apparatus 1 according to a first embodiment will be described using FIG. 2. The image forming apparatus 1 is a laser beam printer which forms an image by heating a developed toner image and fixing the toner image to a sheet. The image forming apparatus 1 includes a sheet feeding unit 130 and an image forming unit 150. In the sheet feeding unit 130, a sheet P stacked in a cassette 2 which stores the sheet P is picked up by a feed roller 3 one by one from an uppermost sheet of the sheet P. The sheet P picked up by the feed roller 3 is sent to a registration portion formed by a registration driving roller 4 and a registration driven roller 5. Then, the sheet P is aligned in a conveyance direction at the registration portion, and thereafter conveyed to the image forming unit 150.

The image forming unit 150 includes a photosensitive drum 6, which is an image bearing member, a charge unit 7, which charges the photosensitive drum 6, a developing unit 8, which develops an electrostatic latent image on the photosensitive drum 6 with a toner, and a cleaner 9, which removes a residual toner on the photosensitive drum 6. The photosensitive drum 6 rotates in an arrow direction in FIG. 2. A peripheral surface of the photosensitive drum 6 is uniformly charged by the charge unit 7. Above the image forming unit 150, a laser scanner 10 which irradiates the laser beam on the charged photosensitive drum 6 in accordance with an image information and forms the electrostatic latent image on the photosensitive drum 6 is disposed. The electrostatic latent image on the photosensitive drum 6 is developed by the developing unit 8 as a toner image. Then, a developed toner image is transferred to the sheet P at a transfer portion 12 formed by a transfer roller 11 and the photosensitive drum 6. The sheet P transferred with the toner image is conveyed to a fixing apparatus 13, and the toner image on the sheet P is fixed by the fixing apparatus 13. The sheet P passed through the fixing apparatus 13 is discharged to a sheet stacking portion 15 by a sheet discharge roller pair 14.

Configuration of Fixing Apparatus

Figure 3:
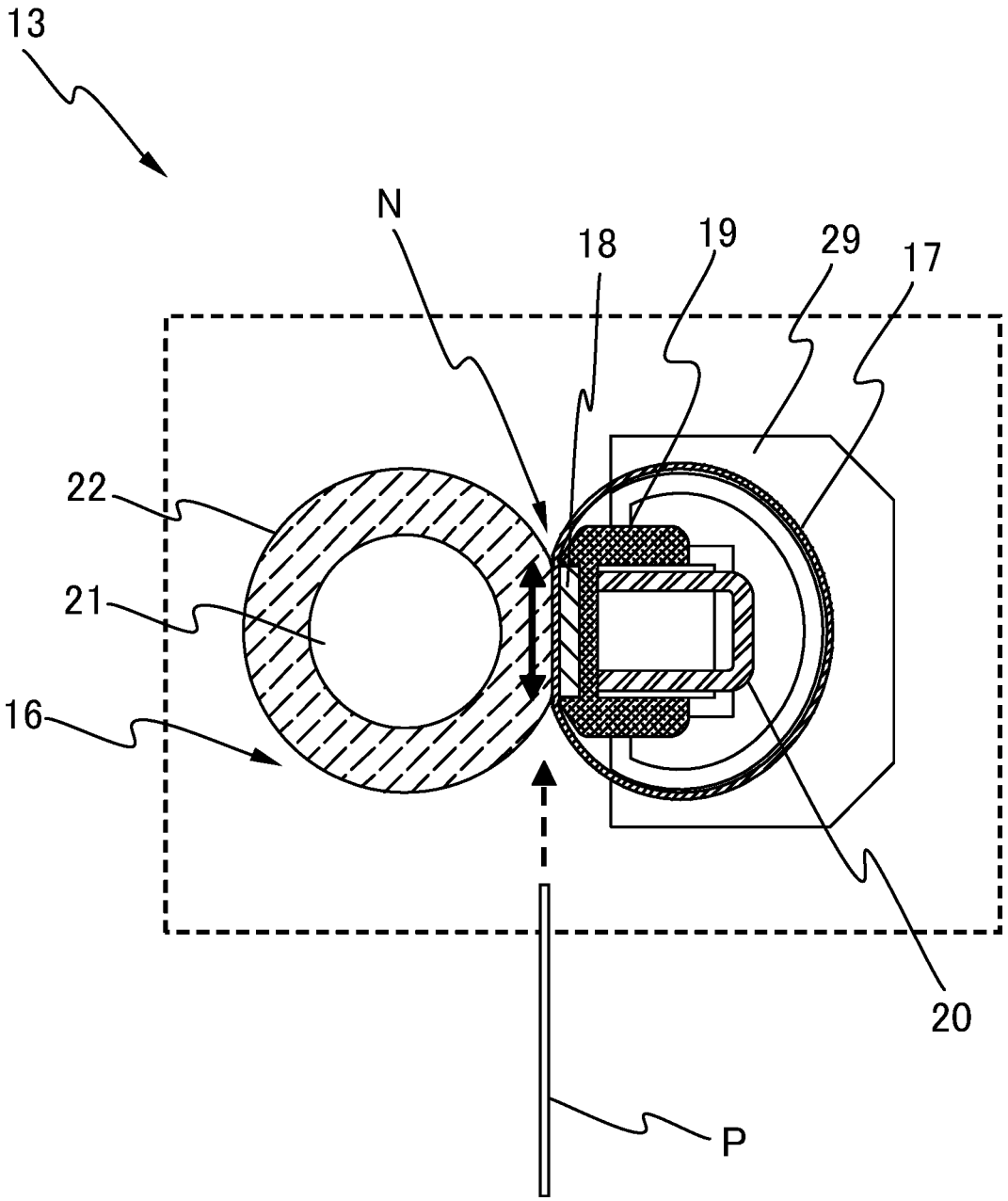
FIG. 3 is a cross-sectional view of the fixing apparatus of the first embodiment.

Next, the fixing apparatus 13 of this embodiment will be described. Hereinafter, with respect to the fixing apparatus 13 and components of the fixing apparatus 13, a longitudinal direction is a direction perpendicularly intersecting with a sheet conveyance direction, that is, a width direction of the sheet. FIG. 3 is a cross-sectional view of the fixing apparatus 13 when viewed in the conveyance direction, and the fixing apparatus 13 will be described using FIG. 3. The fixing apparatus 13 is a press roller driving type and film heating type fixing apparatus, which rotatably drives a press roller 16 and rotates a heating film 17 by a conveyance force of the press roller 16, and attachable to and detachable from the image forming apparatus 1. In the fixing apparatus 13, a heater 18 is supported by a heater holder 19. Further, a pressing stay 20 is disposed on an opposite side of the heater 18 across the heater holder 19. The pressing stay 20 comes into contact with the heater holder 19, and it transmits an urging force to the press roller 16, serving as a first rotary member, which consists of a core shaft portion 21, serving as a first shaft, and a heat resistance elastic layer 22. The heating film 17, which is a second rotary member, externally fits to outer sides of the heater holder 19, the heater 18, and the pressing stay 20. Further, since the heater holder 19 is urged toward an axis of the press roller 16 via the pressing stay 20, a nip portion N is formed between the heating film 17 and the press roller 16. When the sheet P passes through the nip portion N, the toner on the sheet P is heated, melted, and bonded under pressure to the sheet P, and fixed to the sheet P.

Figure 4A:
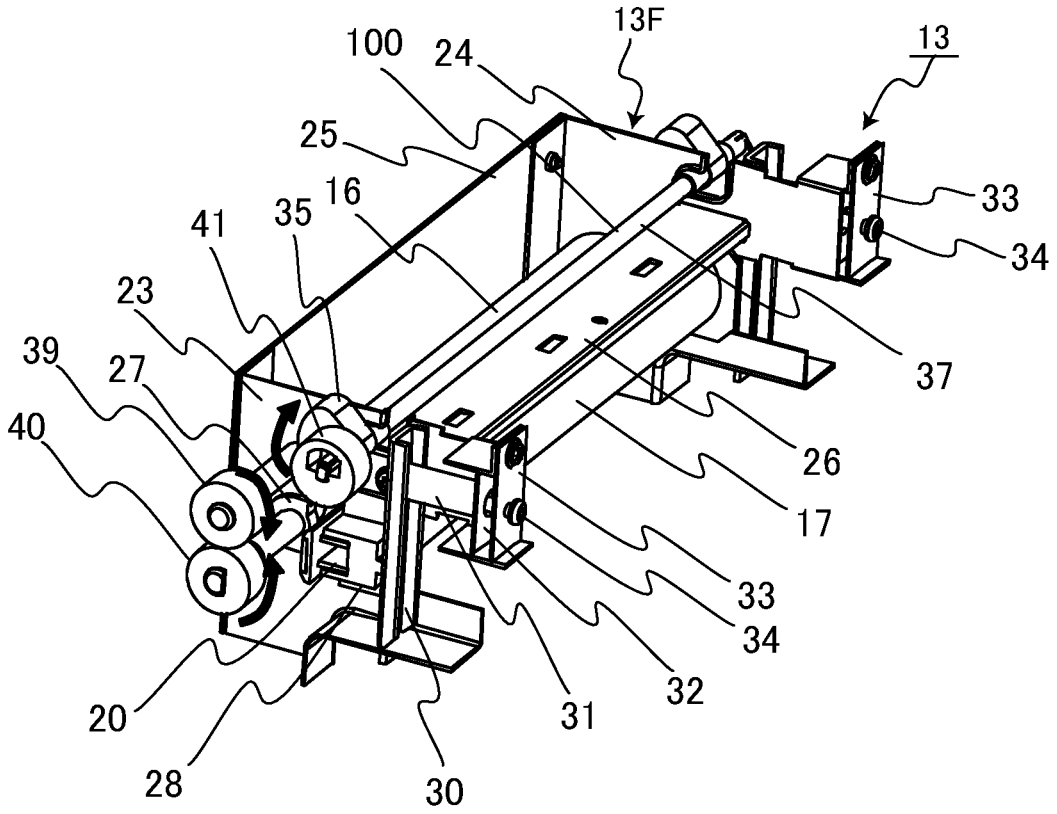
FIG. 4A is a perspective view of the fixing apparatus of the first embodiment.
Figure 4B:
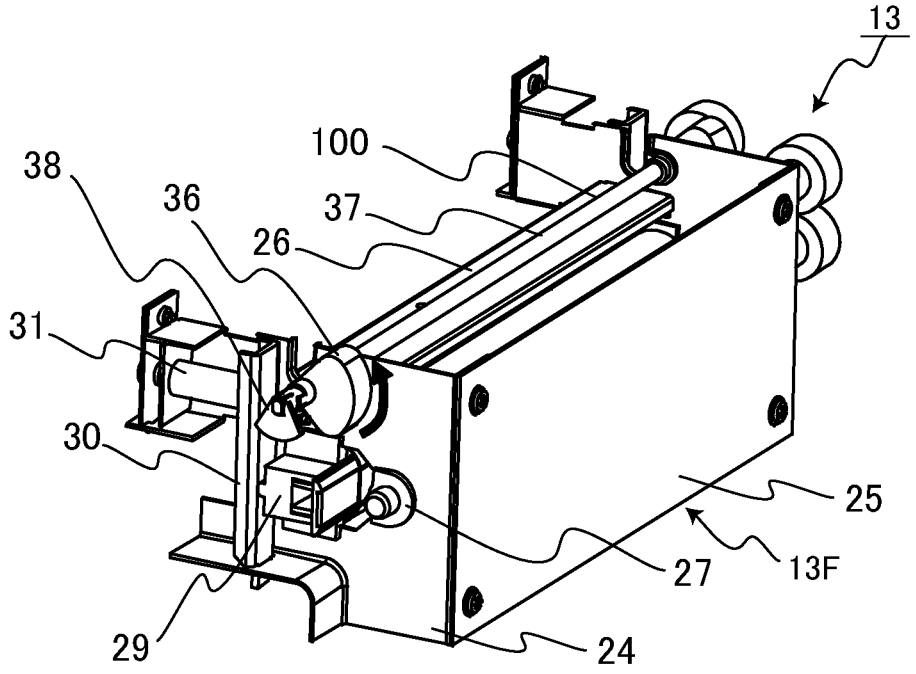
FIG. 4B is a perspective view of the fixing apparatus of the first embodiment.

At this time, in a case where a paper jam occurs in passage of the sheet P through the nip portion N, the heating film 17 and the press roller 16 are separated for a user to handle the paper jam easily. Therefore, the fixing apparatus 13 of this embodiment includes a nip pressure adjustment mechanism which brings the heating film 17 into contact with the press roller 16 and separates the heating film 17 from the press roller 16. Further, the nip pressure adjustment mechanism of this embodiment moves the heating film 17 in a direction in which the heating film 17 is separated from the press roller 16. That is, since it is not necessary to move the press roller 16 which includes a rotary drive transmission mechanism, it is possible to simplify the nip pressure adjustment mechanism Configuration of Nip Pressure Adjustment Mechanism Next, a configuration of the nip pressure adjustment mechanism will be described. FIGS. 4A and 4B are a perspective view of the fixing apparatus 13. A frame 13F of the fixing apparatus 13 is formed by fastening a pair of side plates 23 and 24, a base plate 25, and a plate 26, which bridges the side plates 23 and 24, with each other by screws. To each of the side plates 23 and 24 of the frame 13F, a bearing 27 which rotatably supports each end of the core shaft portion 21 of the press roller 16 is fixed. The press roller 16 rotates in an arrow direction in FIG. 4A by a driving force of gears 39 and 40. Further, to both ends of the pressing stay 20, flanges 28 and 29 are fixed, and parts of the flanges 28 and 29 are in contact with an inner circumferential surface of the heating film 17 and regulate a motion path of the heating film 17. Further, the flanges 28 and 29 are supported by the side plates 23 and 24 in a sheet conveyance direction, and they transmit an urging force to the pressing stay 20. The pressing stay 20, the flanges 28 and 29, the heater holder 19, the heater 18, and the heating film 17 are movable in a direction in which an urging force of the press roller 16 is generated when a nip pressure adjustment at the nip portion N is performed (refer to FIG. 3).

The urging force in this embodiment is a force generated by urging members 31, first ends of which are fixed to fixed plates 32 and second ends of which are fixed to pressing plates 30. The urging member 31 of this embodiment is, for example, an elastic body such as a compression spring, and uses a reaction force generated at a compression of the elastic body as the urging force. That is, an urging direction of the urging member 31 is the same as a direction of the reaction force of the urging member 31. Positions of the fixed plates 32 in the urging direction of the urging members 31 are determined by pressuring screws 34 fixed to tapped holes of top plates 33 fixed to each of the side plates 23 and 24. Further, the pressing plates 30, which are pressing members, have fulcrums F (refer to FIGS. 1A and 1B) in the side plates 23 and 24, and transmit the reaction forces of the urging members 31 to the flanges 28 and 29 as the urging force. The pressing plates 30 are plate-shaped members, and supported between the urging members 31 and opening portions 52 provided in each of the side plates 23 and 24 (refer to FIGS. 1A and 1B). Since a distance between the fulcrum F of the pressing plate 30 and each of the flanges 28 and 29, which are working points, is shorter than a distance between the fulcrum F and each of the urging members 31, which are force points, it is possible to generate the urging force which is larger than the reaction force of the urging member 31.

Then, in this embodiment, the pressing plates 30 are moved by rotation of cams 35 and 36. Herewith, it is possible to move components on a side of the heating film 17 including the flanges 28 and 29 in a direction in which the heating film 17 is separated from the press roller 16. In particular, the cams 35 and 36 are fixed to a shaft 37, which is a second shaft, and rotatably supported with respect to the side plates 23 and 24. In a contact state where the press roller 16 and the heating film 17 come into contact with each other and form the nip portion N, the pressing plates 30 do not come into contact with the cams 35 and 36. On the other hand, in a state where the press roller 16 withdraws from the heating film 17 and the nip pressure at the nip portion N becomes smaller than the nip pressure in the contact state, each of the cams 35 and 36 rotates in an arrow direction in FIGS. 4A and 4B and comes into contact with each of the pressing plates 30. By coming into contact with the cams 35 and 36, the pressing plates 30 move in a separating direction. To be noted, a distance between center positions of the press roller 16 and the heating film 17 in a state where the nip pressure at the nip portion N is large is a first distance of this embodiment, and positions of the press roller 16 and the heating film 17 in this state are first positions. The state where the nip pressure at the nip portion N is large is, for example, the contact state where the press roller 16 and the heating film 17 come into contact with each other. Further, a distance between the center positions of the press roller 16 and the heating film 17 in a state where the nip pressure at the nip portion N is small is a second distance of this embodiment, and the positions of the press roller 16 and the heating film 17 in this state are second positions. A state where the nip pressure at the nip portion N is small is, for example, a state where the distance between the center positions of the press roller 16 and the heating film 17 is larger in comparison with the distance in the contact state. That is, in a state where the press roller 16 and the heating film 17 are separated from each other, the nip pressure at the nip portion N becomes smaller than the nip pressure in the contact state. To be noted, when the pressing plate 30 is moved in the separating direction, the pressing plate 30 moves in a direction to lower the nip pressure at the nip portion N, and, in this case, the pressing plate 30 is moved to enlarge the distance between the center positions of the press roller 16 and the heating film 17 as compared with the distance in the contact state. Further, when the pressing plate 30 is moved in a coming into contact direction, the pressing plate 30 moves in a direction to increase the nip pressure at the nip portion N, and the pressing plate 30 moves to shorten the distance between the center positions of the press roller 16 and the heating film 17 as compared with the distance in a separated state.

At this point, a driving force to rotate the cams 35 and 36 is transmitted from a gear 57 (refer to FIG. 8), which is disposed in the image forming apparatus 1 and serves as an output gear rotatably driven by a driving source such as a motor, to a gear 41, which serves as an input gear supported by the shaft 37 of the cam 35. To be noted, it is possible to detect phases of the cams 35 and 36 by detecting interception or transmission of an optical axis of a photo sensor 38*a* (refer to FIG. 2) with a detected unit 38. An output value of the photo sensor 38*a* changes depending on the interception or transmission of the optical axis of the photo sensor 38*a* due to changes in the phase of the detected unit 38. Hereinafter, the shaft 37, the cams 35 and 36, and the detected unit 38 are collectively referred to as a cam unit 100. To be noted, in this embodiment, considering an interception performance to intercept the optical axis and an anti-wear performance in sliding motion, the detected unit 38 and the cam 36 are provided independently from each other. Incidentally, it is desirable to dispose the cam unit 100 at a position which is far from each of the fulcrums F of the pressing plates 30 (refer to FIGS. 1A and 1B). This is because it is possible to reduce required force to move the pressing plates 30 in the separating direction by disposing the cam unit 100 at the position far from each of the fulcrums F of the pressing plates 30. Herewith, since vertical drag between each of the cams 35 and 36 and the pressing plate 30 is reduced and friction force resulting from contact of each of the cams 35 and 36 with the pressing plate 30 is lessened, durability of the cams 35 and 36 is improved. To be noted, in this embodiment, the cam unit 100 is disposed at the farthest position from each of the fulcrums F of the pressing plates 30 on each of upper ends of the side plates 23 and 24.

Procedure for Assembly and Mounting of Cam Unit

Figures 5A, 5B:
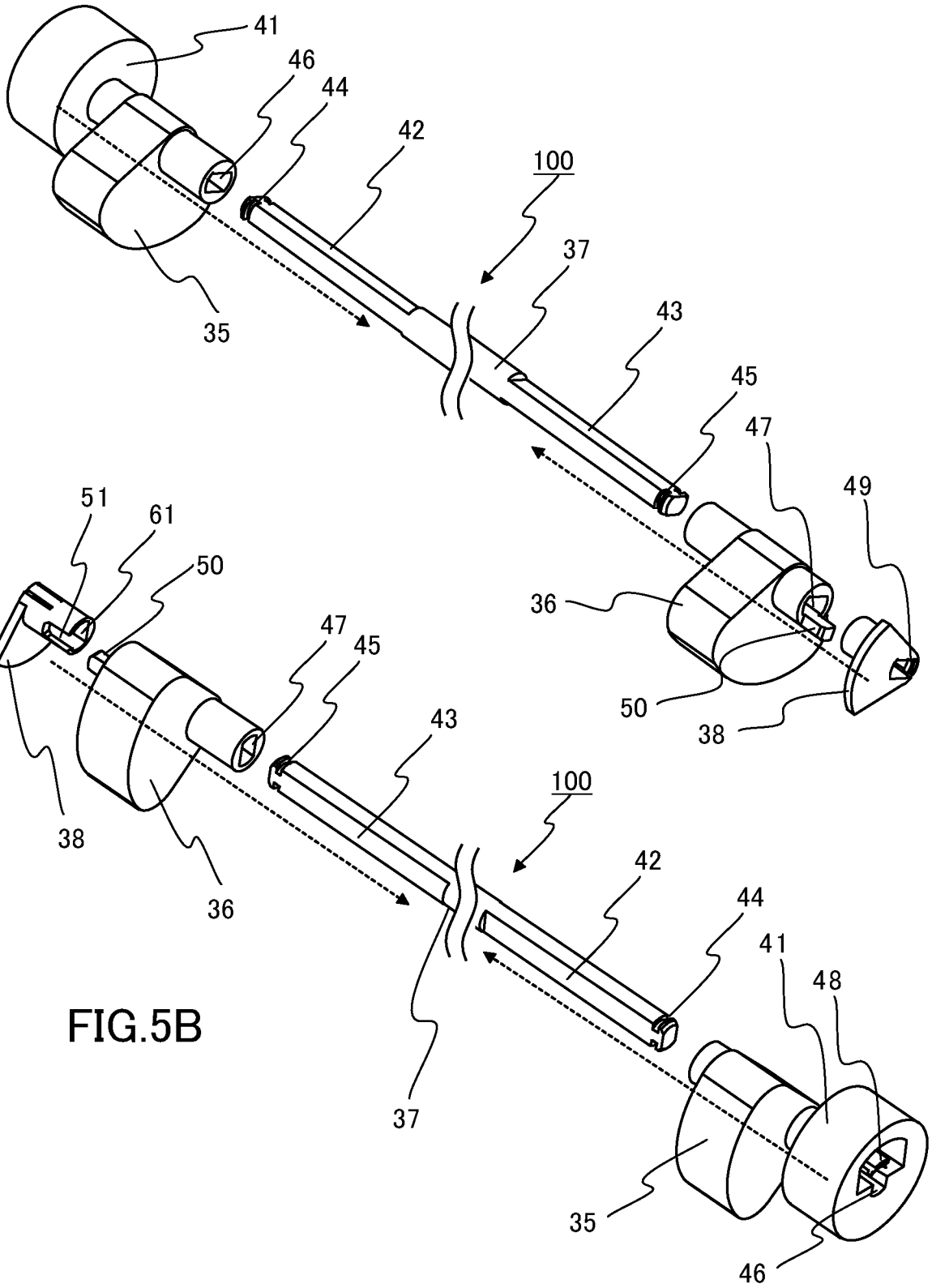
FIG. 5A is a diagram illustrating an assembly process of a cam unit of the first embodiment.
FIG. 5B is a diagram illustrating the assembly process of the cam unit of the first embodiment.

Next, an assembly procedure of the cam unit 100 will be described. FIGS. 5A and 5B show a configuration of the cam unit 100. Rotation stop portions 42 and 43 and grooves 44 and 45 are formed in the shaft 37, which is the second shaft rotatably supporting the cams 35 and 36. The rotation stop portions 42 and 43 are disposed along a longitudinal direction of the shaft 37, that is an axial direction of the shaft 37, and regulate rotation of the cams 35 and 36, the gear 41, and the detected unit 38. Further, holes 46, 47, and 61 are formed in the cams 35 and 36, the gear 41, and the detected unit 38 along an outer peripheral surface of the rotation stop portions 42 and 43. Then, the rotation stop portions 42 and 43 engage with the holes 46, 47, and 61, and the rotation of the cams 35 and 36, the gear 41, and the detected unit 38 around the shaft 37 are regulated. The grooves 44 and 45 regulate movements of the cams 35 and 36 and the detected unit 38 with respect to the axial direction of the shaft 37. Claw portions 48 and 49 which are capable of engaging with the grooves 44 and 45 are formed in the gear 41 and the detected unit 38. Then, the claw portions 48 and 49 engage with the grooves 44 and 45, and movements of the gear 41, the cams 35 and 36, and the detected unit 38 in the axial direction of the shaft 37 are regulated.

Next, an assembly process of the cam unit 100 will be described. First, the cam 35 which is integrated with the gear 41 is moved from a first end of the shaft 37 in the axial direction and is inserted onto the shaft 37 until the claw portion 48 engages with the groove 44. Next, the cam 36 and the detected unit 38 are inserted onto the shaft 37 in this sequence from a second end of the shaft 37 in the axial direction until the claw portion 49 engages with the groove 45. To be noted, a projecting portion 50 (refer to FIG. 5A) and a concave portion 51 (refer to FIG. 5B) are respectively provided in the cam 36 and the detected unit 38, and the projecting portion 50 and the concave portion 51 engage with each other in a state where the cam unit 100 is in a single state. By configuring the cam unit 100 as described above, precision of a phase of the detection unit 38 with respect to a phase of the cam 36 is improved, and it is possible to improve precision of the nip pressure adjustment at the nip portion N (refer to FIG. 3). To be noted, in this embodiment, with the aims of reducing number of components and assembly steps, the rotation stop portions 42 and 43 are used to regulate the rotation of the cams 35 and 36 with respect to the shaft 37. However, it is not limited to this, and acceptable to regulate the rotation of the cams 35 and 36 by boring holes in the shaft 37 and inserting a parallel pin in the holes.

Figure 1A:
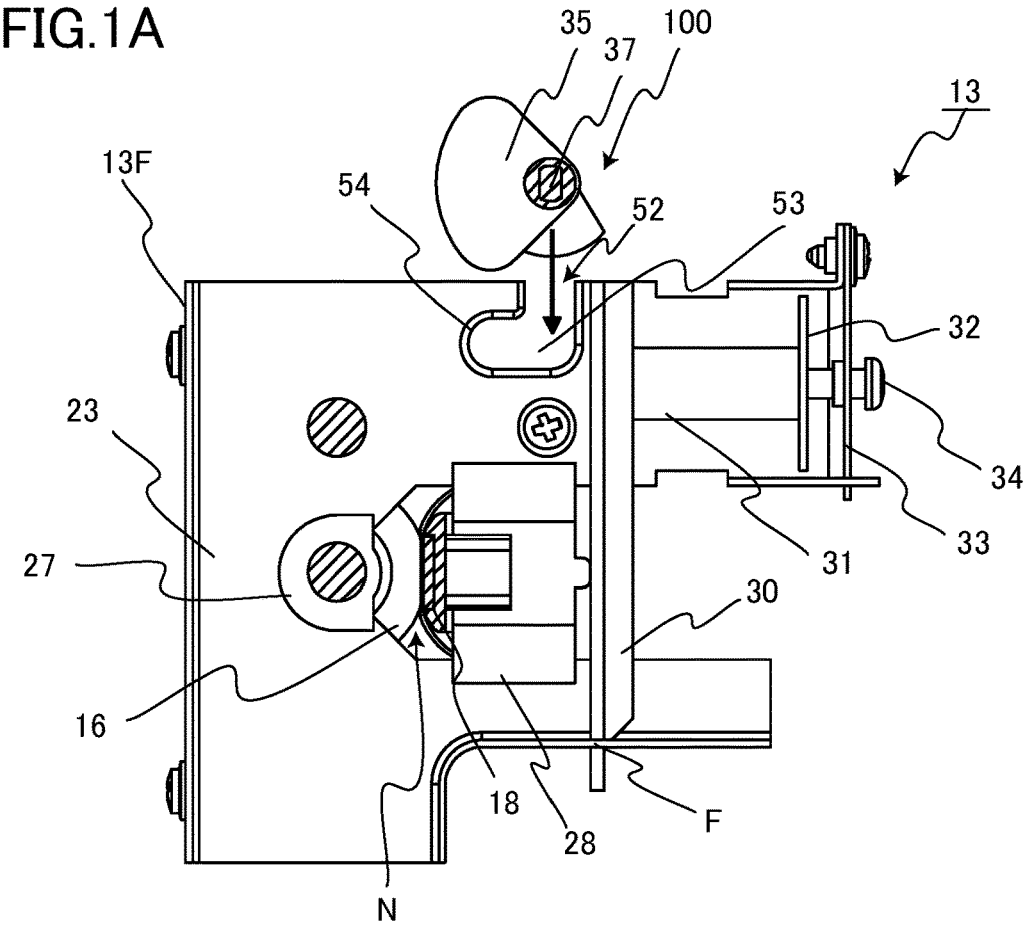
FIG. 1A is a diagram illustrating an assembly process of a fixing apparatus of a first embodiment.
Figure 1B:
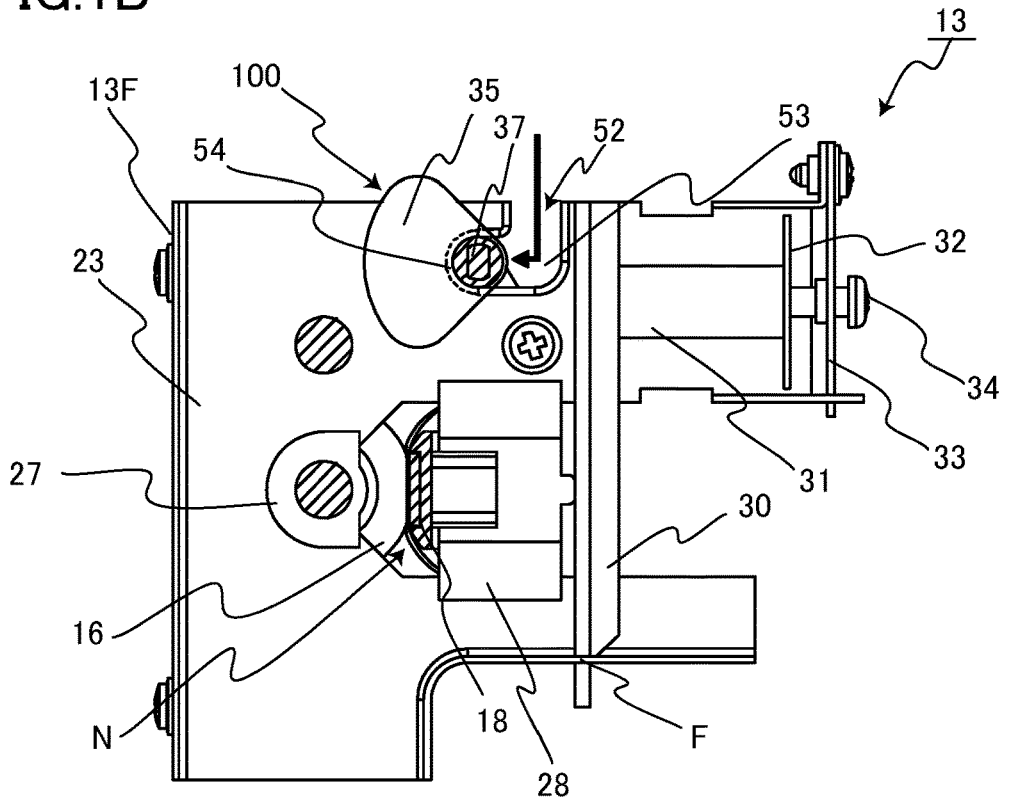
FIG. 1B is a diagram illustrating the assembly process of the fixing apparatus of the first embodiment.

Next, a mounting process of the cam unit 100 to the side plates 23 and 24 will be described. To be noted, since the side plates 23 and 24 are similar in a shape and assembly, the mounting process of the cam unit 100 on the side plate 23 will be described as an example FIGS. 1A and 1B show the mounting process of the cam unit 100 on the side plate 23. FIGS. 1A and 1B show a cross-sectional view of the fixing apparatus 13 when viewed in the axial direction of the shaft 37 at a position between the gear 41 and the cam 35. To be noted, FIGS. 1A and 1B show a state where the press roller 16, members on the side of the heating film 17 including the flanges 28 and 29, and a mechanism to transmit the urging force of the urging member 31 including the pressing plate 30 are assembled on the side plates 23 and 24. That is, in a case where the cam unit 100 is not mounted on the frame 13F, the fixing apparatus 13 is in the contact state where the press roller 16 and the heating film 17 come into contact with each other.

At an edge of the side plate 23, the opening portion 52 and a groove 53 communicating with the opening portion 52 are formed. The opening portion 52 is sized to allow an entrance of the shaft 37 of the cam unit 100, and configured to make the shaft 37 movable so that the cam unit 100 is capable of reaching the groove 53 via the opening portion 52 after the shaft 37 has entered into the opening portion 52. The groove 53, serving as a bearing groove of this embodiment, is formed in a direction from the edge of the side plate 23 to inside the side plate 23. In a state where the cam unit 100 is supported by the side plates 23 and 24, a receiving portion 54 on which the shaft 37 receives the urging force of the urging member 31 via the cam 35 and the pressing plate 30 is formed in the groove 53. FIGS. 1A and 1B show the groove 53 which is formed to extend in an L shape from the edge of the side plate 23 to inside the side plate 23 and includes the receiving portion 54 at an end thereof. In particular, the groove 53 includes a first portion 53*a* which extends along an urging direction F1, which is a first direction of this embodiment, of the urging member 31, and a second portion 53*b* which extends in a direction intersecting with the first portion 53*a* and communicates with the opening portion 52 (refer to FIG. 11C). Further, a downstream end of the groove 53, that is the receiving portion 54, in the urging direction F1 is formed in a circular-arc shape (refer to FIG. 11C).

In a case where the groove 53 is formed in the L shape as shown in FIGS. 1A and 1B, the groove 53 receives the urging force of the urging member 31 on the downstream edge of the first portion 53*a* in the urging direction of the urging member 31. That is, the receiving portion 54 is at the downstream edge of the first portion 53*a* in the urging direction of the urging member 31, and the urging force of the urging member 31 is provided to the receiving portion 54 from the shaft 37 via the cam 35 and the pressing plate 30. When mounting the cam unit 100 on the side plate 23, at first, the shaft 37 is entered into the opening portion 52. At this time, any rotational phase of the cam unit 100 is acceptable if the cam 35 does not come into contact with the pressing plate 30 at the rotational phase. Next, the cam unit 100 is entered along the groove 53 in an arrow direction in FIG. 1B until the shaft 37 reaches the receiving portion 54. Herewith, dimensional relation between an inner circumference of the receiving portion 54 and an outer periphery of the shaft 37 becomes a loose fit, and the cam unit 100 becomes rotatable by the driving force from the gear 41.

Figure 6:
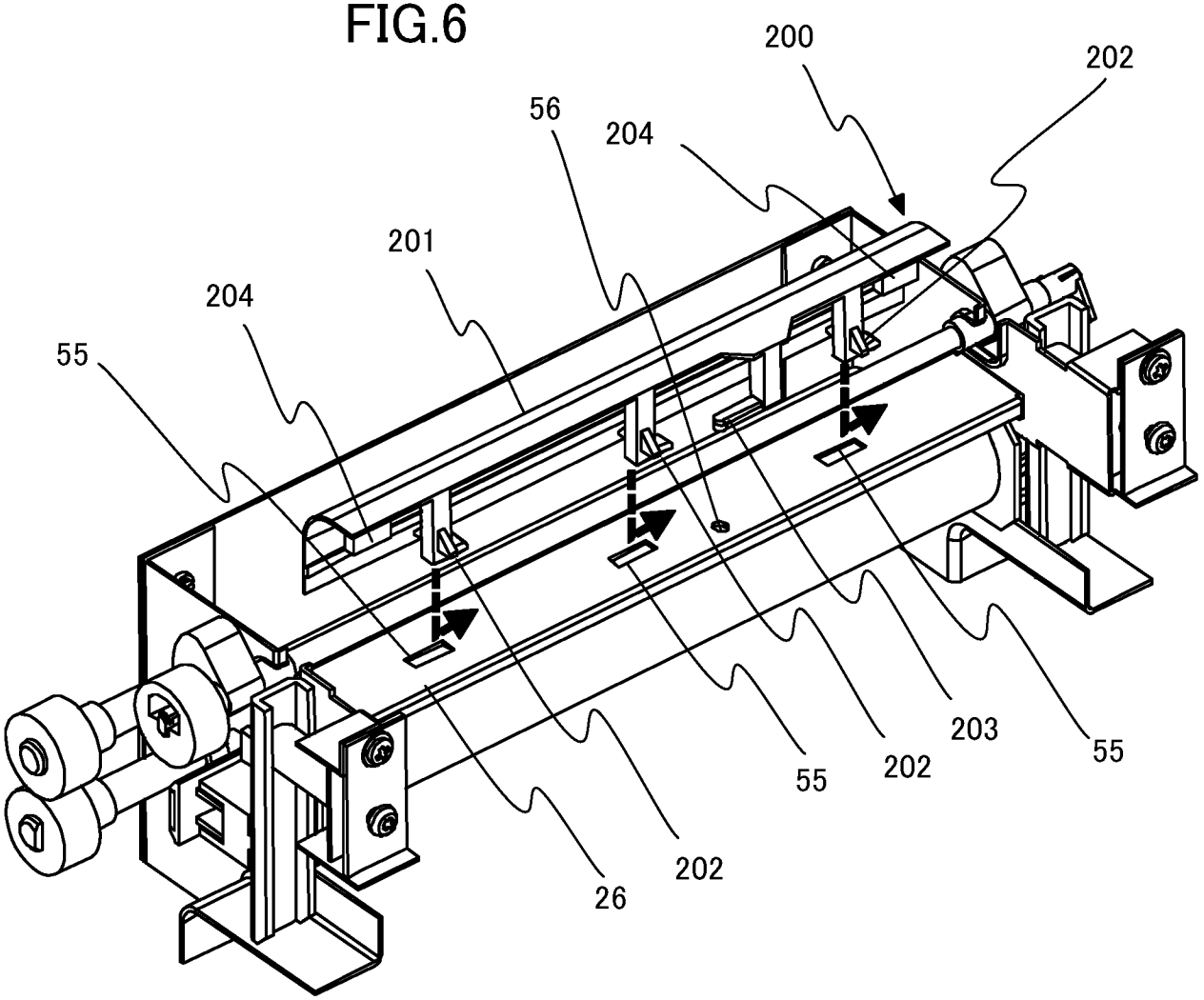
FIG. 6 is a diagram illustrating a mounting process of a conveyance guide of the first embodiment.

Then, an assembly process to determine a rotational position of the cam unit 100 will be described. Since there is clearance between the pressing plate 30 and the cam 35 only by moving the cam unit 100 along the groove 53, the rotational position of the cam unit 100 is not determined in a case where the fixing apparatus 13 is in the contact state. In response to this, a positioning portion 204 is provided to determine a position of the shaft 37 to the groove 53, and the rotational position of the cam unit 100 is determined. In this embodiment, the positioning portion 204 is disposed on a conveyance guide 200 which is attachable to and detachable from the plate 26. FIG. 6 is a diagram showing a mounting process of the conveyance guide 200. The conveyance guide 200, serving as a guide portion in this embodiment, guides the sheet to downstream of the nip portion N in the sheet conveyance direction, and is fixed on the plate 26. In particular, on a back surface of a guide surface 201 which guides the sheet P, that is, on a surface facing the plate 26, a fixing portion 202, a claw portion 203, and the positioning portion 204 are formed. By hanging the fixing portion 202 in a hole 55 provided in the plate 26 while sliding in a longitudinal direction, it is possible to determine a position of the conveyance guide 200 in each direction except for the longitudinal direction. Further, by bending the claw portion 203 and engaging the claw portion 203 with a hole 56 in the plate 26, it is possible to determine the position of the conveyance guide 200 in the longitudinal direction. The fixing portion 202 and the claw portion 203 which support the conveyance guide 200 by being engaged with the plate 26 are supporting portions of this embodiment. Then, in a state where the fixing portion 202 and the claw portion 203 are respectively engaged with the holes 55 and 56, the positioning portion 204 is positioned to close the opening portion 52.

Figure 7:
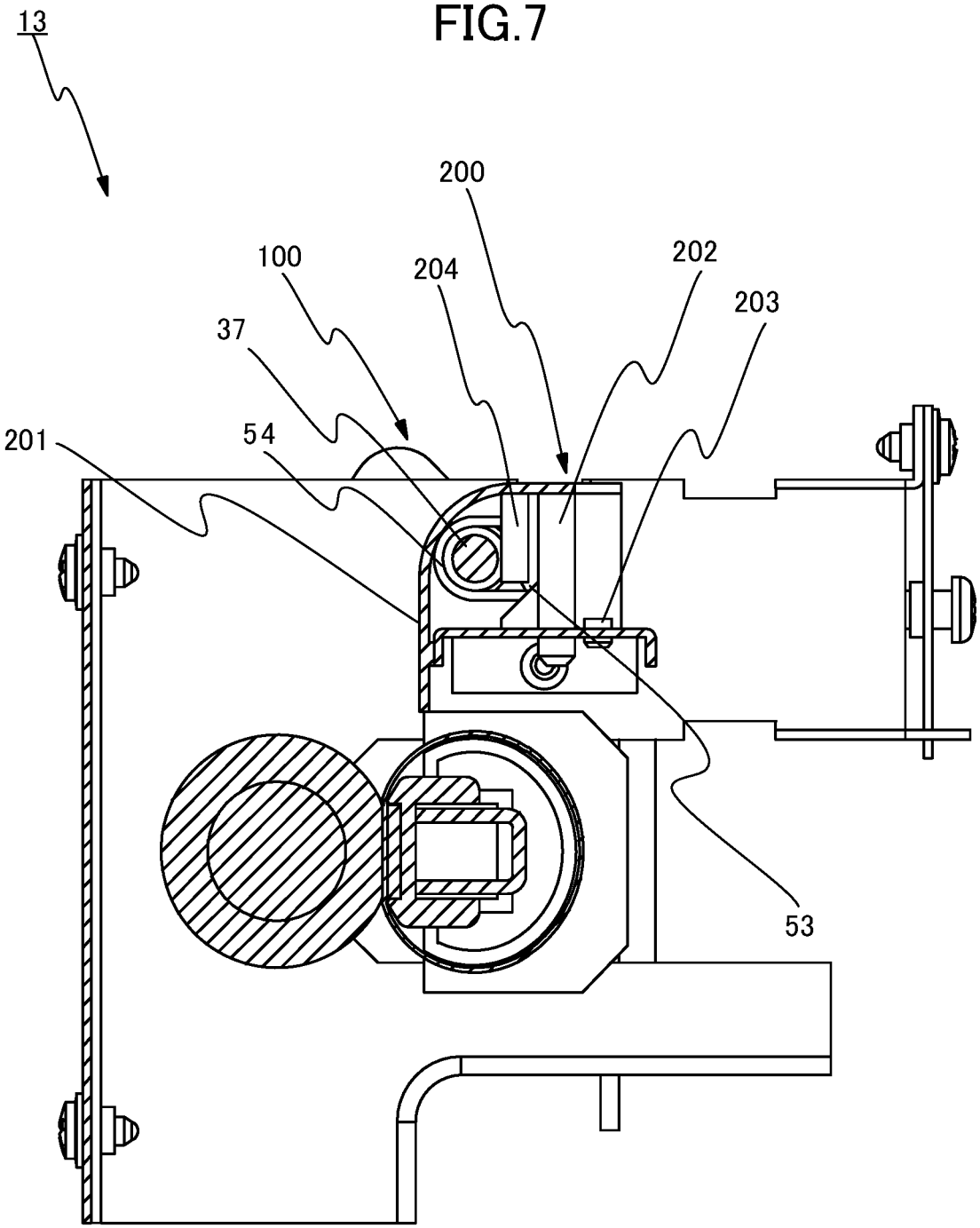
FIG. 7 is a diagram illustrating a positioning process of a shaft of the cam unit of the first embodiment.

FIG. 7 shows a cross-sectional view of the fixing apparatus 13 in a state where the opening portion 52 is closed by the positioning portion 204. At this time, in the fixing apparatus 13, the outer periphery of the shaft 37 is fitted into the inner circumference of the receiving portion 54 by the positioning portion 204, and the rotational position of the cam unit 100 in the groove 53 is determined. Thus, even in a case where there is the clearance between the pressing plate 30 and the cam 35 (refer to FIG. 4A), it is possible to fix the rotational positions of the shaft 37 and the cam unit 100 in the groove 53 at the receiving portion 54 by attaching the conveyance guide 200 to the plate 26 (refer to FIG. 6). As described above, in this embodiment, it is not necessary to directly fix a rotation shaft of a cam to the frame as hitherto, but possible to prevent a dislodgement of the cam unit 100 from the frame 13F due to an erroneous operation of the user, a vibration, and the like. Further, since the positioning portion 204 is disposed at the conveyance guide 200, it is possible to reduce the number of components and the size of apparatus. Further, it is possible to detach the cam unit 100 from the fixing apparatus 13 without detaching the cams 35 and 36 from the cam unit 100 and without detaching the urging member 31 and the pressing plate 30 from the fixing apparatus 13. Therefore, it is possible to easily replace the cam unit 100 in the fixing apparatus 13, and possible to improve ease of the assembly of the cam unit 100.

Regulation of Rotation Shaft Movement

Figure 8A:
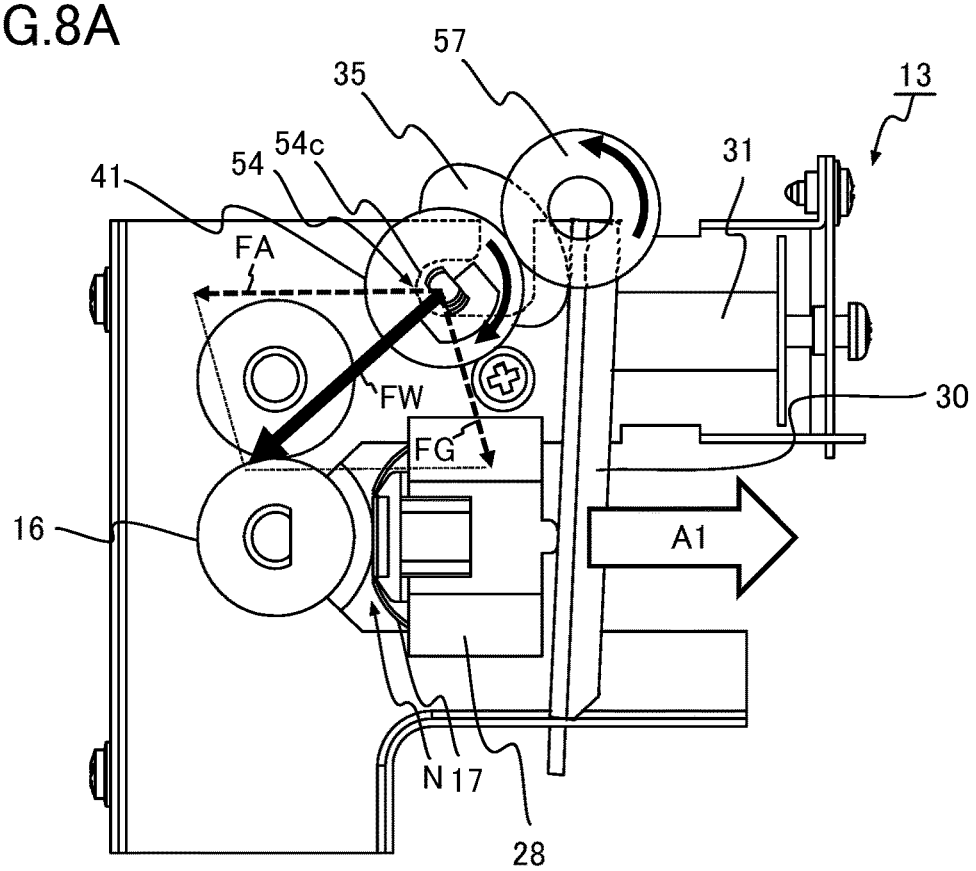
FIG. 8A is a diagram illustrating relation between a direction of force, which a cam receives, and a receiving portion in the fixing apparatus of the first embodiment.
Figure 8B:
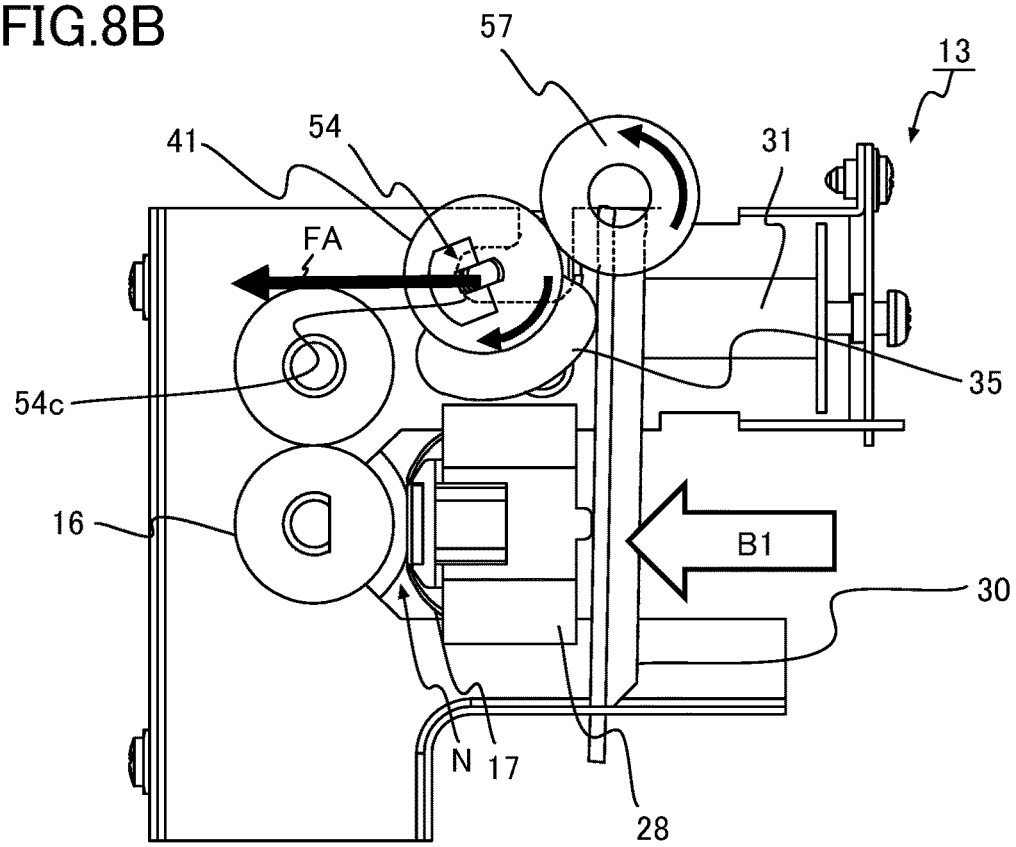
FIG. 8B is a diagram illustrating the relation between the direction of the force, which the cam receives, and the receiving portion in the fixing apparatus of the first embodiment.

Next, with reference to FIGS. 8A and 8B, relation between a direction of force received by the cams 35 and 36 and the receiving portion 54 in a nip pressure adjustment operation will be described. FIGS. 8A and 8B are diagrams showing the direction of force received by the cam 35 in the nip pressure adjustment operation of the nip portion N. In FIGS. 8A and 8B, the cam 35 will be described as an example, and, similar to the cam 35, the nip pressure adjustment operation of the nip portion N is carried out also at the cam 36.

At first, an operation to reduce the nip pressure at the nip portion N by enlarging a distance between the central positions of the press roller 16 and the heating film 17 will be described. As shown in FIG. 8A, in a case where the nip pressure at the nip portion N is to be reduced, the cam 35 is rotated to come into contact with the pressing plate 30 so that the pressing plate 30 is pushed up in a direction (arrow A1 direction in FIG. 8A, separating direction) to reduce the urging force of the urging member 31. In this operation, a force which the cam 35 receives is a resultant force FW of the urging force FA of the urging member 31 which is transmitted via the pressing plate 30 and a driving force FG in a direction of a pressure angle formed by an engagement of the gear 41 and the gear 57, which is disposed on a side of a body of the image forming apparatus 1. Further, the resultant force FW is also provided to the shaft 37 via the cam 35. At this time, a direction of the resultant force FW is within a range of an inner circumference 54*c* of the receiving portion 54. Therefore, in the operation to reduce the nip pressure at the nip portion N, the shaft 37 slides while coming into contact with the receiving portion 54. In this case, by adjusting a position of the receiving portion 54, it is possible to adjust the distance between the central positions of the press roller 16 and the heating film 17, a distance between the gears 41 and 57, and a position of the detected unit 38 (refer to FIG. 5) with respect to the photo sensor 38*a* (refer to FIG. 2).

Next, with reference to FIG. 8B, an operation to increase the nip pressure at the nip portion N by shortening a distance between the central positions of the press roller 16 and the heating film 17 will be described. In a case where the nip pressure at the nip portion N is to be increased, the cam 35 is rotated to move the pressing plate 30 so that the pressing plate 30 is moved in a direction (arrow B1 direction in FIG. 8B, coming into contact direction) to receive the urging force of the urging member 31. In this operation, a moment of the urging force of urging member 31, which is centered upon the cam 35, is the same direction as a rotational direction of the gear 41. That is, the cam 35 is rotated by the urging force of the urging member 31 without the driving force of the gear 41. Therefore, in the operation to increase the nip pressure at the nip portion N, the cam 35 does not receive the driving force FG (refer to FIG. 8A) in the direction of the pressure angle formed by the engagement of the gear 41 and the gear 57, and receives only the urging force FA from the pressing plate 30. Further, the urging force FA is also provided to the shaft 37 via the cam 35. At this time, a direction of the force which the cam 35 receives in the operation to increase the nip pressure at the nip portion N is within the range of the inner circumference 54*c* of the receiving portion 54. Therefore, in the operation to increase the nip pressure at the nip portion N, the shaft 37 slides while coming into contact with the receiving portion 54. In this case, by adjusting the position of the receiving portion 54, it is possible to adjust the distance between the pitches of the gears 41 and 57, and the position of the detected unit 38 (refer to FIG. 5) with respect to the photo sensor 38*a* (refer to FIG. 2).

As described above, since the receiving portion 54 and the cam 35 are configured to adjust the nip pressure at the nip portion N by sliding in a state where the receiving portion 54 and the cam 35 come into contact with each other, similar to a nip pressure adjustment mechanism having a closed circular shape of the receiving portion 54 as hitherto, it is possible to adjust the nip pressure at the nip portion N. However, when the cam 35 rotates in a state where the press roller 16 and the heating film 17 come into contact with each other, since the cam 35 is not in contact with the pressing plate 30, only the driving force FG (refer to FIG. 8A) in the direction of the pressure angle formed by the engagement of the gear 41 and the gear 57 is generated. In this state, although the shaft 37 moves in a direction of detaching from the receiving portion 54, the shaft 37 does not fall from the receiving portion 54 since the position of the shaft 37 to the receiving portion 54 is determined by the positioning portion 204 (refer to FIG. 7). That is, since the position of the shaft 37 is determined to the receiving portion 54, the rotational phase of the cam 35 is stabilized. To be noted, since the cam 35 does not receive a large urging force from the urging member 31 in a state where the shaft 37 moves to detach from the receiving portion 54, large strength is not required for an installation of the positioning portion 204 to the opening portion 52. Regarding the installation strength of the positioning portion 204 to the opening portion 52, for example, any strength with which the dislodgment of the cam unit 100 by the erroneous operation of the user or during transportation is preventable is acceptable. Further, in this embodiment, the side plates 23 and 24 are made of a sheet metal, and the groove 53 and the edge of the receiving portion 54 are formed in a drawing shape. Herewith, since it is not only possible to prevent damage to the cams 35 and 36 but also possible to reduce surface pressure by increasing contact surfaces of the cams 35 and 36 with the receiving portions 54, wear resistance of the cams 35 and 36 is improved.

Second Embodiment

Configuration of Fixing Unit

Next, a second embodiment of this disclosure will be described. To be noted, the same components with the same functions as the first embodiment have the same reference characters, and overlapping descriptions will be omitted herein.

Figure 9:
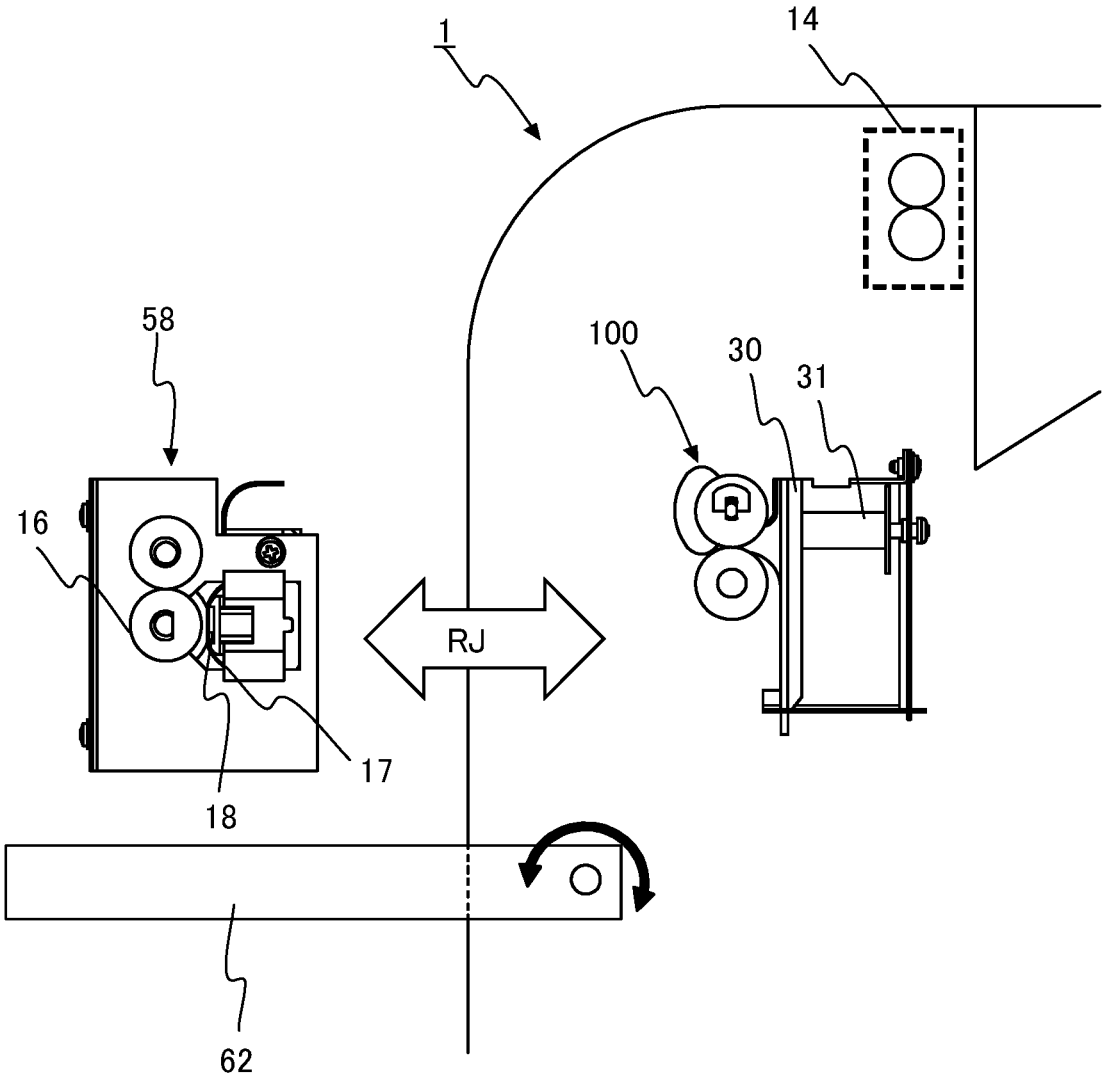
FIG. 9 is a diagram illustrating an assembly process of a fixing unit of a second embodiment.

Configuration Disposed of Cam Unit and Pressing Mechanism to Image Forming Apparatus FIG. 9 is a diagram illustrating a mounting process of a fixing unit 58 on the image forming apparatus 1. The nip pressure adjustment mechanism consisting of such as the cam unit 100, the pressing plate 30, and the urging member 31 is disposed on the side of the image forming apparatus 1. The fixing unit 58 includes the press roller 16, the heating film 17, and the heater 18, and the heater 18 is supported by the heater holder 19. Further, the pressing stay 20 is disposed on the opposite side of the heater 18 across the heater holder 19 (refer to FIG. 3). The fixing apparatus 58 is attachable to and detachable from a casing of the image forming apparatus 1 by opening and closing a door 62 of the casing of the image forming apparatus 1.

Figure 10:
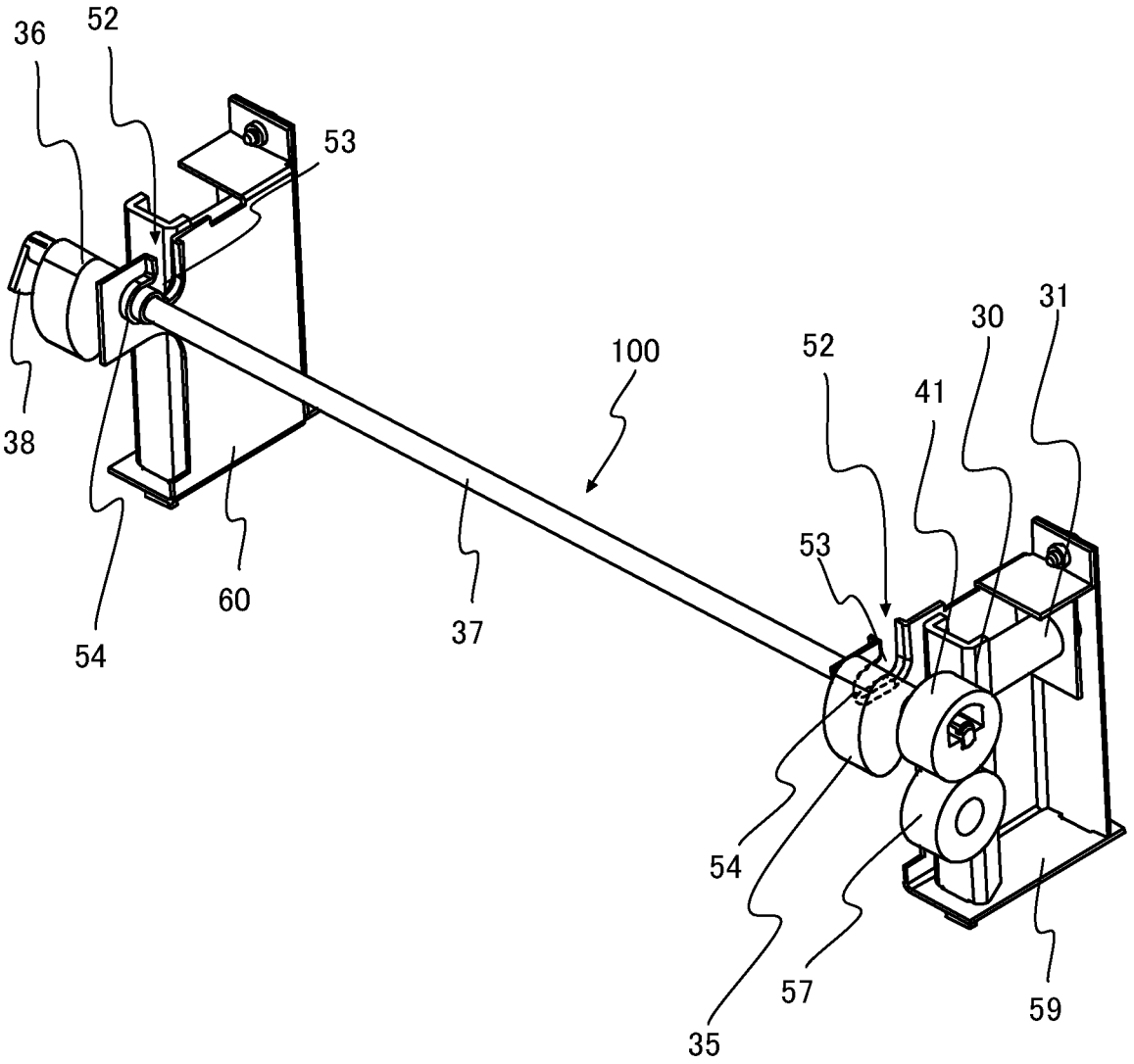
FIG. 10 is a diagram illustrating a mounting process of a cam unit of the second embodiment.

Next, with reference to FIG. 10, a mounting process of the cam unit 100 of this embodiment will be described. First, inside the casing of the image forming apparatus 1, side plates 59 and 60 are disposed in a fixed state. On the side plates 59 and 60, the cam unit 100, the pressing plates 30, and the urging members 31 are mounted. Similar to the side plates 23 and 24 of the first embodiment (refer to FIGS. 1 and 4), the opening portion 52 and the groove 53 are provided to each of the side plates 59 and 60, and when mounting the cam unit 100, the cam unit 100 is moved from the opening portion 52 of each of the side plates 59 and 60 to the receiving portions 54 of the grooves 53. To be noted, it is acceptable to provide a member which includes the positioning portions 204 (refer to FIG. 7) so as to prevent the dislodgement of the shaft 37 of the cam unit 100 from the receiving portions 54. To be noted, when mounting the cam unit 100 on the side plates 59 and 60 in the second embodiment, the gear 57 has been already mounted on the side of the image forming apparatus 1. Therefore, the opening portion 52 and the receiving portion 54 of each of the side plates 59 and 60 are disposed at positions where the gear 41 of the cam unit 100 does not interfere with the gear 57, and also at positions where, in the nip pressure adjustment operation, the cams 35 and 36 are slidable while coming into contact with the receiving portions 54.

In the configuration as described above, in a case where the sheet is jammed inside the fixing unit 58, the driving force is transmitted from the gear 57 of the image forming apparatus 1 to the gear 41, and by rotating the cam unit 100 the nip pressure at the nip portion N is reduced. Herewith, when pulling out the fixing unit 58 from the image forming apparatus 1, it is possible to prevent the fixing unit 58 from being popped out by the urging force of the urging members 31. Then, the sheet is removed from the fixing unit which has been pulled out. In jam handling as described above, in this embodiment, it is not necessary to operate any units other than the fixing unit 58, it is possible to improve operability of the jam handling.

OTHER EMBODIMENTS

Figure 11A:
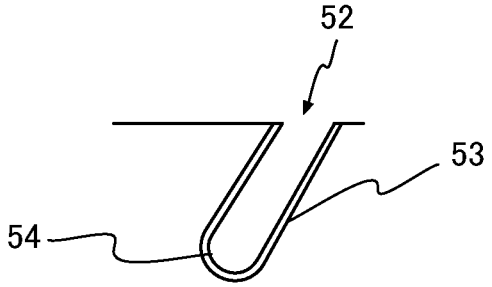
FIG. 11A is a diagram illustrating the other shape of a bearing groove.
Figure 11B:
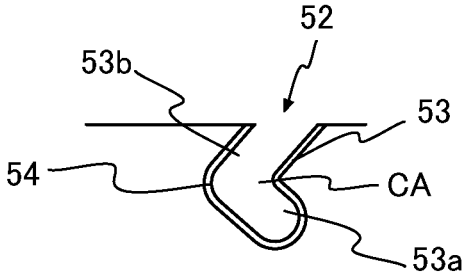
FIG. 11B is a diagram illustrating the other shape of the bearing groove.
Figure 11C:
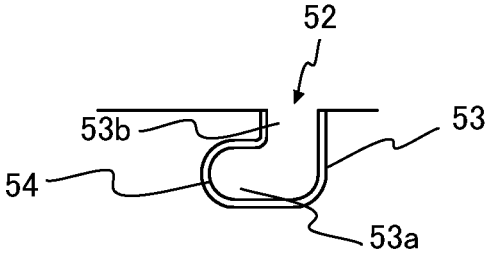
FIG. 11C is a diagram illustrating the other shape of the bearing groove.
Figure 11D:
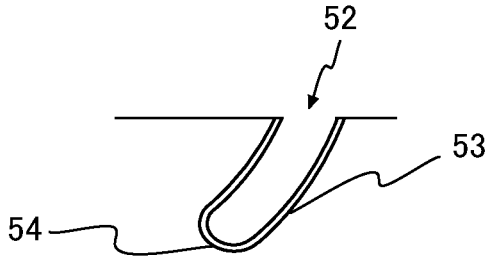
FIG. 11D is a diagram illustrating the other shape of the bearing groove.

In the descriptions of the first and the second embodiment, a shape of the groove 53 is described as the L-shape as shown in FIG. 11C. However, any shapes (refer to FIGS. 11A, 11B, 11D, and 11E) other than this are acceptable if the receiving portion 54 is placed at a position which is farther apart from the pressing plate 30 than the opening portion 52 in the urging direction F1 of the urging member 31 (refer to FIGS. 1A and 1B). With these shapes, in a state where the shaft 37 is going to disengage from the receiving portion 54, it is difficult for the shaft 37 to fall out from the receiving portion 54. FIGS. 11A, 11B, 11C, 11D, and 11E show examples of the shapes of the groove 53. FIG. 11A is a diagram showing the groove 53 in which the receiving portion 54 is disposed at a position which is farther apart from the pressing plate 30 than the opening portion 52 in the urging direction F1, and the groove 53 in FIG. 11A is a linear shape. Further, FIG. 11D is a diagram showing the groove 53 in which the receiving portion 54 is disposed at a position which is farther apart from the pressing plate 30 than the opening portion 52 in the urging direction F1, and the groove 53 in FIG. 11D is a curved shape. Since, similar to the first and the second embodiment, the position of the shaft 37 (refer to FIG. 5) is determined to the receiving portion 54 in cases of the shapes shown in FIGS. 11A and 11D, it is possible to stabilize the rotational phase of the cam unit 100 (refer to FIG. 5).

Figure 11E:
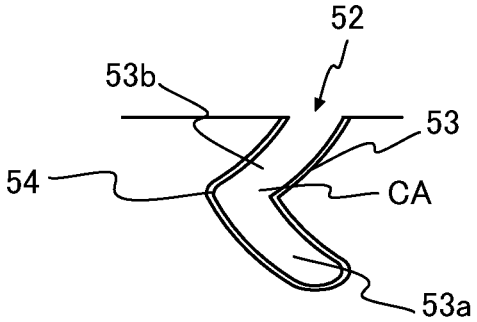
FIG. 11E is a diagram illustrating the other shape of the bearing groove.
Figure 11E:
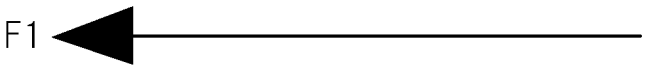

Regarding a shape of the groove 53, it is acceptable that, as shown in FIGS. 11B and 11E, the groove 53 includes the first portion 53*a*, which extends in a direction intersecting with the urging direction F1 of the urging member 31, and the second portion 53*b*, which extends in a direction intersecting with the urging direction F1 and communicates with the opening portion 52. FIG. 11B is a diagram of the groove 53 in which the first portion 53*a* and the second portion 53*b* are linear, and FIG. 11E is the diagram in which the first portion 53*a* and the second portion 53*b* are curved. In FIGS. 11B and 11E, the receiving portion 54 is disposed at a position which is farther apart from the pressing plate 30 than the opening portion 52 in the urging direction F1, and it is disposed at a communicating point CA where the first portion 53*a* communicates with the second portion 53*b*. Since, similar to the first and the second embodiment, the position of the shaft 37 (refer to FIG. 5) is determined with respect to the receiving portion 54 even in the shapes shown in FIGS. 11B and 11E, it is possible to stabilize the rotational phase of the cam unit 100 (refer to FIG. 5).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191261, filed Oct. 18, 2019, which is hereby incorporated by reference herein in its entirety.

What is claimed is:

1. A fixing apparatus comprising:

a first rotary member configured to rotate around a first shaft;

a second rotary member disposed so as to come into contact with and separate from the first rotary member, and configured to form a nip portion with the first rotary member;

a heater configured to heat the nip portion;

a frame comprising a pair of side plates;

a pressing member supported by the pair of side plates, and configured to press the second rotary member, wherein the pressing member is configured to be movable between a first position, where a distance between center positions of the first rotary member and the second rotary member is a first distance, and a second position, where the distance between the center positions of the first rotary member and the second rotary member is a second distance which is larger than the first distance;

an urging member configured to urge the pressing member toward the first position;

a second shaft supported by the pair of side plates so as to be attachable to and detachable from the pair of side plates; and a cam rotatably supported by the second shaft, and configured to change a position of the pressing member between the first position and the second position, wherein each of the pair of side plates comprises an opening portion which is disposed at an edge of each of the pair of side plates and into which the second shaft enters, and a bearing groove which communicates with the opening portion, wherein the bearing groove comprises a receiving portion which receives an urging force which the second shaft receives from the urging member via the pressing member and the cam in a state where the second shaft is supported by the pair of side plates, and wherein the receiving portion is disposed at a position which is farther apart from the pressing member than the opening portion in an urging direction of the urging member when viewed in an axial direction of the first shaft.

2. The fixing apparatus according to claim 1, further comprising an input gear attached to the second shaft so as to engage with an output gear which is rotated by being provided with a driving force, wherein, in a case where the cam is rotated by the driving force transmitted via the output gear and the input gear, the receiving portion is configured to receive a resultant force of a force which the second shaft receives due to an engagement of the output gear and the input gear and an urging force which the second shaft receives from the urging member via the pressing member and the cam.

3. The fixing apparatus according to claim 1, wherein the receiving portion is disposed at an end of the bearing groove.

4. The fixing apparatus according to claim 3, wherein the bearing groove comprises a first portion which extends along the urging direction and a second portion which extends in a direction intersecting with the urging direction and communicates with the opening portion, and the bearing groove is formed to extend in an L shape from the edge, and wherein the receiving portion is at a downstream end of the first portion in the urging direction.

5. The fixing apparatus according to claim 1, wherein the bearing groove comprises a first portion which extends along a first direction intersecting with the urging direction and a second portion which extends in a direction intersecting with the first direction and the urging direction and communicates with the opening portion, and wherein the receiving portion is at a position where the first portion communicates with the second portion.

6. The fixing apparatus according to claim 1, further comprising a detected unit disposed at a first end of the second shaft in the axial direction and configured to change a phase along with a rotation of the cam, and a sensor configured to change an output value along with the phase of the detected unit.

7. The fixing apparatus according to claim 1, further comprising a positioning portion configured to determine a position of the second shaft which is supported by the receiving portion.

8. The fixing apparatus according to claim 7, further comprising a guide portion which is configured to guide a sheet to the nip portion, wherein the frame comprises a plate which is configured to bridge the pair of side plates, and wherein the guide portion comprises a supporting portion which is supported by the plate, a guide surface which extends from the supporting portion toward the nip portion and guides the sheet, and the positioning portion which is disposed on a surface facing the plate in the supporting portion, and the guide portion is configured to be attachable to and detachable from the plate.

9. The fixing apparatus according to claim 1, wherein, when viewed in the axial direction, the pressing member is a plate-shaped member and supported by the pair of side plates between the urging member and the opening portion.

10. The fixing apparatus according to claim 1, wherein the cam is configured to be attachable to and detachable from the second shaft.

11. The fixing apparatus according to claim 1, comprising a fixing unit which is configured to be attachable to and detachable from the frame, and wherein the fixing unit comprises the first rotary member, the second rotary member, and the heater.

12. The fixing apparatus according to claim 1, wherein the first shaft and the second rotary member are supported by the pair of side plates.

13. An image forming apparatus comprising:

a casing;

an image forming unit configured to form an image on a sheet; and the fixing apparatus according to claim 1, wherein the fixing apparatus is configured to be attachable to and detachable from the casing.

14. The fixing apparatus according to claim 1, wherein the first rotary member is a press roller, and the second rotary member is a cylindrical film, wherein the heater is provided in an inner space of the film, and wherein the nip portion is formed by the press roller and the heater through the film.

* * * * *